United States Patent [19]

Stocker

[11] 4,429,589

[45] Feb. 7, 1984

[54] DUAL RATIO ACCELERATOR PEDAL ASSEMBLY

[75] Inventor: Raymond Stocker, West Bloomfield, Mich.

[73] Assignee: Ford Motor Company, Dearborn, Mich.

[21] Appl. No.: 394,210

[22] Filed: Jul. 1, 1982

[51] Int. Cl.[3] ..... G05G 1/14

[52] U.S. Cl. ..... 74/513; 74/516; 74/522

[58] Field of Search ..... 74/512, 513, 514, 516, 74/518, 522

[56] References Cited

U.S. PATENT DOCUMENTS

| | | | |
|---|---|---|---|
| 1,929,409 | 10/1933 | Carr | 74/512 |
| 2,167,868 | 8/1939 | Best | 74/501 X |
| 2,936,867 | 5/1960 | Perry | 74/513 |
| 3,264,896 | 8/1966 | Gorsky | 74/516 |
| 3,410,152 | 11/1968 | Krusemark | 74/516 |
| 3,446,091 | 5/1969 | Stocker | 74/513 |
| 3,490,294 | 1/1970 | Antrim | 74/516 |
| 3,646,830 | 3/1972 | Shrock | 74/516 |
| 3,739,579 | 6/1973 | Lutz | 74/512 |
| 3,938,407 | 2/1976 | Nisbet | 74/516 |
| 4,069,722 | 1/1978 | Derrick | 74/516 |
| 4,372,178 | 2/1983 | Ota | 74/512 |
| 4,385,528 | 5/1983 | Paulnels | 74/512 |
| 4,386,537 | 6/1983 | Lewis | 74/516 |

FOREIGN PATENT DOCUMENTS

| | | | |
|---|---|---|---|
| 869600 | 7/1949 | Fed. Rep. of Germany | 74/516 |

*Primary Examiner*—Lawrence J. Staab
*Assistant Examiner*—Anthony W. Raskob, Jr.
*Attorney, Agent, or Firm*—Joseph W. Malleck; Olin B. Johnson

[57] ABSTRACT

A dual ratio accelerator arm assembly is disclosed. The assembly provides a slow first throttle opening rate through a first arc of movement of the arm assembly and then a discrete change to a higher throttle opening rate through a second arc of movement of the arm that noticeably signals a higher fuel consumption. The assembly comprises an accelerator arm, a bracket supporting the arm for operable movement, a pair of pivot pins carried by the arm, and means in the bracket for defining at least one pair of first and second pivot pin receptacles. Each receptacle is associated with one of the pins, has a fulcrum segment, and is effective to allow limited movement of the pin therein. The first segment, with its fulcrum segment engaged by its associated pin, defines a force applying lever arm which is shorter than the force applying lever arm defined by the second receptacle with its associated pin in engagement with its fulcrum segment.

13 Claims, 4 Drawing Figures

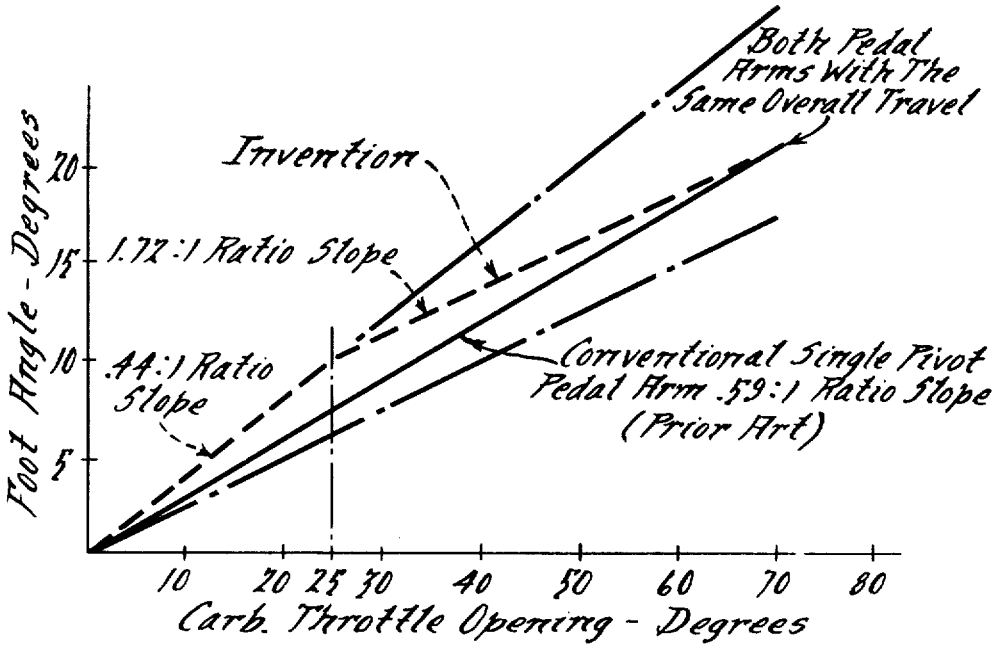
FIG. 3.
FIG. 4.
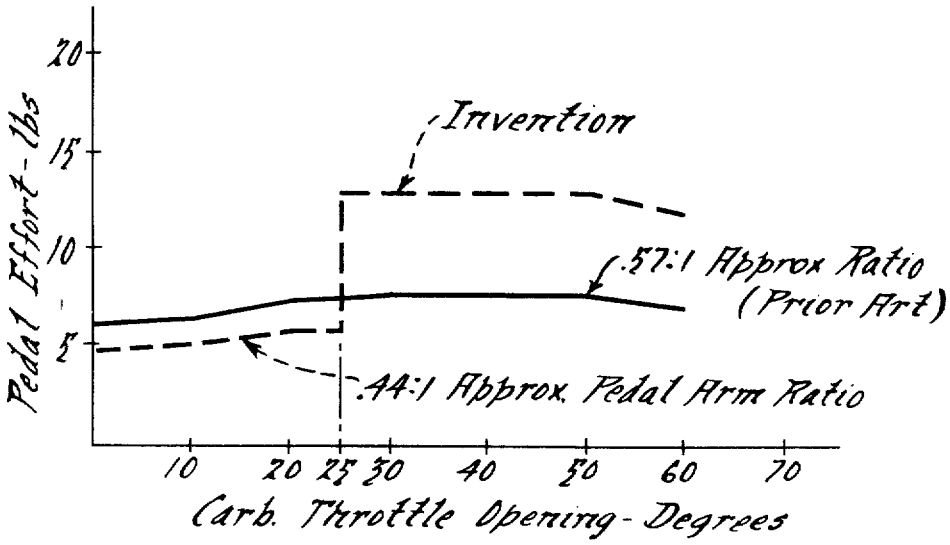

DUAL RATIO ACCELERATOR PEDAL ASSEMBLY

BACKGROUND OF THE INVENTION AND PRIOR ART STATEMENT

The need for variable ratio lever assemblies has been recognized in the art of making brake pedal assemblies because of the increasing braking load that the operator experiences as the brake pedal is depressed. However, such pedal assemblies, because of the desire for a continuously increasing mechanical advantage, have used a fixed pedal pivot with a camming arrangement to shift the length of the level arms (see U.S. Pat. Nos. 4,069,722; 3,938,407; and 3,410,152). The use of cams to change the mechanical advantage of an accelerator pedal assembly would be undesirable because it requires a stationary pivot which, in turn, does not allow maintaining the required, greater mechanical advantage through the first arc of movement of the accelerator arm.

The operating conditions for an accelerator pedal assembly differ from that of braking assemblies. It is desirable that the mechanical advantage shift from a high to a lower value as the pedal is depressed, this permits a slower throttle opening rate in the first stages of the pedal movement followed by a faster throttle opening rate when the pedal approaches wide open throttle (WOT). Secondly, the travel for an accelerator pedal operating on two or more lever ratios should travel through a distance no greater than that required for a conventional accelerator pedal moving about a single fixed pivot at a unitary mechanical advantage. Thirdly, the change in mechanical advantage should occur as a discrete stepped increment rather than a continuous, unnoticeable variable, this provides a feedback signal to the operator telling him when high fuel consumption conditions are being experienced.

The desire for an initially slow rate of throttle opening followed by a faster rate when approaching WOT has been entertained in U.S. Pat. Nos. 3,490,294 and 3,264,896. However, in each of these patents cams were used to impart a gradual change in the mechanical advantage by (a) changing the effective length of a lever, other than the accelerator pedal, or (b) by changing the lever length of the accelerator pedal without affecting the fulcrum of the pedal itself. Both approaches are costly and do not provide for a sufficient degree of change in the mechanical advantage to be worthwhile.

U.S. Pat. No. 3,646,830 discloses a braking assembly that has used a concept of two lever ratios shifting between two discrete fulcrums. The shift is brought about by the use of a complex set of links that do not stay in position unless some residual pedal force is constantly applied which in turn affects pedal effort.

BRIEF DESCRIPTION OF THE DRAWINGS

FIGS. 3 and 4 are graphical illustrations plotting foot angle against carburetor throttle opening.

SUMMARY OF THE INVENTION

Figures 1, 2:
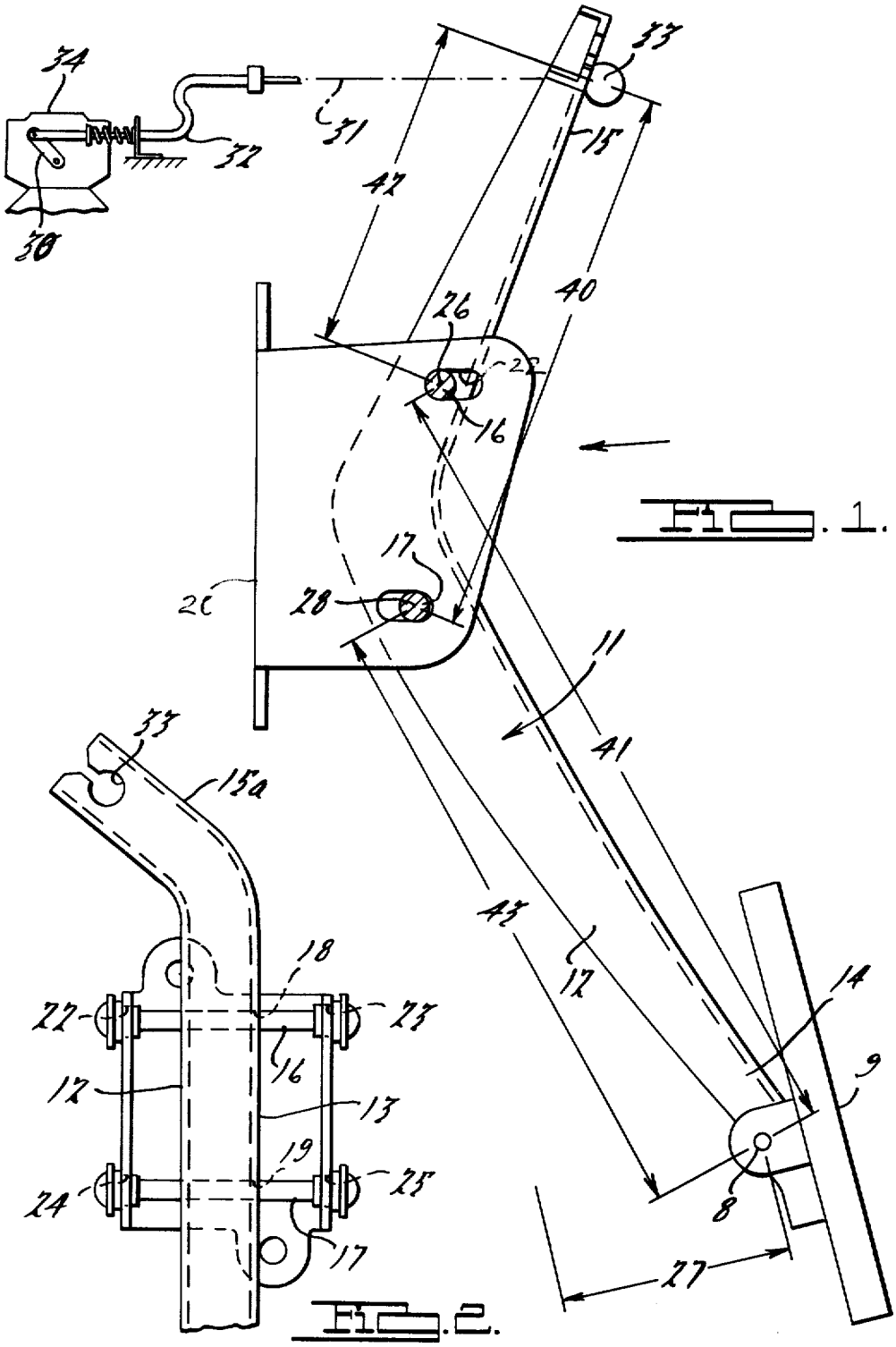
FIG. 1 is a schematic elevational view of an accelerator arm assembly embodying the principles of this invention.
FIG.2 is a side view of a part of the apparatus in FIG. 1.

The invention is a dual ratio accelerator arm assembly that provides a desirably slow first throttle opening rate through a first arc of movement of the arm (advantageously in the range of 8°-12°) and thence a discrete change to a higher throttle opening rate through a second arc of movement of the arm that noticeably signals a higher fuel consumption.

The assembly comprises an accelerator arm having a force applying portion at one extremity and a load receiving portion at the other extremity, a bracket supporting the arm for operable movement, a pair of pivot pins carried by one of said bracket or arm and spaced longitudinally along said arm, and means in the other of said support bracket or arm for defining at least one pair of first and second pivot pin receptacles, each receptacle being respectively associated with one of said pins and effective to allow limited movement of its associated pin therein, each of said receptacles having a fulcrum segment which is effective to form a fulcrum for said arm when its associated pin is engaged therewith, said first receptacle having its segment disposed to define a force applying lever arm which is shorter than the force applying lever arm defined by said segment of said second receptacle with its associated pin engaged therewith, said receptacles being arranged and spaced apart whereby upon application of a force to said arm at said force applying portion the arm will be moved through a first arcuate distance with the segment of said first receptacle engaged with its associated pin while the pin associated with said second receptacle undergoes lost motion, and with continued application of force to said arm the arm will be moved through a second arcuate distance with the segment of said second receptacle engaged with its associated pin while the pin associated with the first receptacle undergoes lost motion.

Preferably, the pins are mounted or attached to the arm and the receptacles are defined in walls of the bracket which may cradle the arm. The arm may be generally L-shaped, having an elbow with the receptacles disposed on opposite sides of the elbow. Preferably, each receptacle is associated with one of the pins and arranged so that upon application of force to the arm at the force applying portion the arm will be moved through a first arc with the first of the pins engaging a side of a first receptable associated therewith to constitute a first fulcrum for the arm. With further or continued movement of the arm beyond said arc, the arm moves through a second arc causing the second of the pins to engage a side of the other receptacle to constitute a second fulcrum for the arm while said first pin undergoes lost motion within said first receptacle.

It is preferred that the lever arm defined between the force applying portion to the first fulcrum is greater than the lever arm defined from the force applying portion to the other fulcrum. Advantageously, a first ratio of the lever arm from the force receiving portion to the first portion, to the lever arm from the first pivot pin to the force applying portion, is less than a second ratio of the lever arm from the force receiving portion to the other pivot pin, to the lever arm from said other pivot pin to the force applying portion. In quantitative terms, it is advantageous that the first ratio be about 0.44 and the second ratio be about 1.72. The ratio of the force applying lever arm for the first receptacle to the force applying lever arm for the second receptacle is 1:2 to 3:4.

It is also preferred that the shift of the fulcrums be designed so that a shift from the first ratio to the second ratio takes place after the pedal arm has moved through a first arcuate movement of between 8-12%, optimally 10°, corresponding to about 25° of movement of the throttle for an engine with which this assembly is associated.

Advantageously, the force applying portion of the arm is connected to a load by a spherical connection. The arm may then drop by force of gravity about such spherical connection to bring about or ensure that the first pin is engaged with the first fulcrum segment of the first receptacle during idling and as a starting position.

It is desirable that the lost motion pin travel within the receptacles be through a dimensional range of about 0.40", assuming the pin diameters are about 0.25".

DETAILED DESCRIPTION

Turning to FIG. 1, the dual ratio accelerator arm assembly comprises an accelerator arm 11 having a force applying portion 14 at one extremity and a load receiving portion 15 at the other extremity. It is preferred that the arm be constructed of sheet metal in a U-shaped channel having depending side walls 12 and 13 (see FIG. 2). As shown in FIG. 1, the channel shaped sheet metal arm is somewhat L-shaped in elevation and has a turned neck 15*a* adjacent the load receiving portion 15 (shown in FIG. 2). The load receiving portion is suitable connected by way of a force transmitting cable 31 to the engine carburetor 34. One end of the cable 31 is connected to the arm by a ball and socket union 33 (spherical connection). The other end of the cable extends through a casing 32 which leads to a carburetor throttle lever 30 associated with the carburetor 34. Resilient means are disposed about the cable at the throttle lever 30 (see FIG. 1) which cooperates with the weight of the accelerator arm to return the accelerator arm to a starting position about its fulcrum. The load receiving portion (which is also the force applying lever with respect to the cable 31) rotates the throttle lever 30 through a typical arcuate movement of about 20°, which is associated with an arcuate movement of the internal throttle valve between 0° and 90°.

The assembly is further comprised of a pair of pivot pins 16–17, here identified as a first pivot pin and a second pivot pin, respectively, the pins being carried by the arm 11 at spaced longitudinal locations. The first pin is spaced more remote from said force applying portion than the second pin. Both of the pins are snuggly received within aligned openings 18–19 associated with said locations in the depending side walls 12–13 of the U-shaped channel arm.

The force applying portion may have a pedal 9 pivotally supported at 8 on the lower extremity of the arm, the pedal being pivotal so as to accommodate greater ease of foot movement when acuating the accelerator arm.

Lastly, the assembly comprises a support bracket 20 having means defining two pairs of pivot pin receptacles 22–23 and 24–25 in the side flanges of the bracket. Each pair of receptacles respectively receives opposite end portions of the pins 16–17. Each of the receptacles has a fulcrum segment which is an arcuate end of the receptacle slot. The segments of a pair of receptacles act together. For example, pin 16, when engaged against the left end of receptacles 22–23, defines a fulcrum about pivot 26; pin 17, when engaged against the left side of receptacle slots 24–25, defines fulcrum 28. The receptacles are sized to provide a lost motion action for each of the pins in moving toward or away from the fulcrum segment or receptacle side that defines the fulcrum, preferably a pin travel movement of about 0.4" for a pin diameter of 0.25". In the engine idle condition, the pins will be located as shown in FIG. 1. The spring associated with the carburetor and cable 31 will have moved the arm back into the position shown. If the arm does not have pin 16 engaged against the left end of receptacles 22–23, the force of gravity on the arm will move the arm the additional arcuate distance about the spherical connection 33 to ensure such contact.

The receptacles are arranged so that upon application of force to the arm 11 at the force applying portion 14 the first pin 16 will remain in engagement with the left side of receptacles 22–23, thereby creating and defining the first fulcrum 26 for the arm. The arm will be moved preferably through a distance 27 for an arm angle of 8°–12°, optimally 10°, corresponding to about a 25° opening of the throttle valve within the carburetor. At the end of this movement, pin 17 will have moved through the lost motion space of receptacles 24–25 to engage the left end of the receptacles. Then, upon further movement of the arm 11 through an additional arc, the arm will apply force to cable 31 with a slower mechanical ratio.

The first and second pins on said arm are spaced apart with respect to the extremities of the lever so that the mechanical advantage of the arm will increase as fulcrum 26 with pin 16 is displaced by fulcrum 28 with pin 17. The ratio of the distance 42 (the distance from the force receiving portion 15 to the first pin 16) to the distance 41 (the distance from the first pin 16 to the force applying portion 14) will increase when the fulcrum shifts from pin 16 to pin 17, the ratio then being between the distance 40 (from the force receiving portion 15 to the pin 17) to the distance 43 (the distance from the force applying portion 14 to the pin 17).

Preferably, the first ratio about fulcrum 26 should be about 0.44 and the ratio about the second fulcrum 28 should be about 1.72. This results in a relatively slow throttle opening rate when fulcrum 26 is operative, as opposed to a faster throttle opening rate when the fulcrum 28 is operative. This decrease of mechanical advantage is illustrated in FIG. 3, wherein the foot angle in degrees is plotted against carburator throttle opening in degrees for the invention herein and for a conventional accelerator pedal assembly having a unitary pivot.

During the first initial arcuate movement of the foot pedal for the invention, there is a greater foot rotation required to obtain a given throttle opening than that for the conventional assembly for throttle openings below 25°. For a faster opening rate above 25°, it shows the rate increasing due to the shift of the fulcrum. The overall pedal travel and foot angle can be kept the same as for the prior art it replaces, thereby preventing package pedal height problems.

To minimize the noise that may result when the accelerator pedal is tipped in abruptly, causing the driveline to undergo a temporary torque reversal backlash, the preferred dual ratio arm assembly of this invention should be used. This "clunk" noise is normally associated with vehicles using an overdrive automatic transmission. The slower initial ratio, and thus slower initial foot movement, is helpful to reduce the degree of momentum change that is experienced with modern transmissions when the driveline is reversed from an overrunning condition of the wheels (as in downhill) to forward acceleration by the engine upon depression of the accelerator pedal.

The dual ratio pedal arm assembly has two pivoting pins. The upper pin provides a higher mechanical advantage, which is a lower ratio than that for the lower pin. The upper arm pivot pin will be in contact with the front edge of its associated receptacle at idle and remains in this location through approximately 25° oi carburetor throttle opening. During this movement pin 17 moves forward in receptacles 24–25. At the 25° opening the lower arm will pivot at fulcrum 28, pin 28 being in contact with the front edge of its associated receptacle. At this point the remaining arm rotation to WOT will be about this pivot. While the arm is pivoting about the lower pin, the upper pivot pin 16 will begin moving rearwardly in its associated receptacle. The above sequence is reversed when backing off of the accelerator pedal.

As shown in FIG. 4, the slowed-down opening rate (below 25° throttle opening) results in recued pedal effort. The reduced effort assists in offsetting the slower ratio at part throttle response field by allowing the foot to pivot freely. At the 25° opening the pedal effort will increase and step abruptly from the lower level to a higher level. The step is placed so that it is beyond the normal cruising range speed pedal position. The lower arm pivot pin and its associated slot can be varied to have the effort step occur at a greater throttle opening. The effort step increases as the step is further delayed if the same overall pedal traval is maintained. The higher resulting effort is not objectionable in a vehicle evaluation of this step even if delayed until the 40° throttle opening is obtained. This step is felt usually in the forced kickdown range where higher loadings from the foot are normal and as a result tend to mask the step increase. Thus the dual ratio pedal arm step or increment can be used to serve as a reminder of unnecessary throttle openings, thereby acting as a fuel saving device.

I claim:

1. A dual ratio accelerator arm assembly for an engine having a throttle moved between an open and closed position, comprising:

(a) an accelerator arm having a force applying portion at one extremity and a load receiving portion operatively engaging the engine's throttle at the other extremity;

(b) a bracket supporting said arm for operable movement;

(c) a pair of pivot pins carried by one of said bracket and arm, and spaced longitudinally along said arm; and (d) means in the other one of said bracket and arm not carrying said pins for defining at least one pair of first and second pivot pin receptacles, each receptacle being respectively associated with one of said pins and effective to allow limited movement of its associated pin therein, each of said receptacles having a fulcrum segment which is effective to form a fulcrum for said arm when its associated pin is engaged therewith, said first receptacle having its segment when disposed against its associated pin to define a first force applying lever arm and said second receptacle having its segment when disposed against its associated pin to define a second force applying lever arm longer than said first force applying lever arm, said receptacles being arranged and spaced apart, whereby upon application of a force to said arm at said force applying portion the arm will be moved through a first arcuate distance with the segment of said first receptacle engaged with its associated pin while the pin associated with said second receptacle undergoes lost motion, and with continued application of force to said arm, the arm will be moved through a second arcuate distance with the segment of said second receptacle engaged with its associated pin while the pin associated with the first receptacle undergoes lost motion.

2. The assembly as in claim 1, in which said arm is generally "L" shaped having an elbow, said receptacles being disposed on opposite sides of said elbow.

3. The assembly as in claim 1, in which said first arcuate distance is in the range of 8°–12°.

4. The assembly as in claim 1, in which the ratio of the length of said first force applying lever arm to said second force applying lever arm is, in the range of 1:2 to 3:4.

5. The assembly as in claim 3, in which said first arcuate distance for said accelerator arm is about 10° and corresponds to about a 25° throttle opening for the engine with which said assembly is associated.

6. The assembly as in claim 1, in which the mechanical advantage about said first pin is 0.44 and about said second pin is 1.72.

7. A dual ratio accelerator arm assembly, comprising:

(a) an accelerator arm having two extremities with a force applying portion at one extremity and a load receiving portion operatively engaging an engine's throttle at the other extremity;

(b) a pair of pivot pins carried by said arm at longitudinally spaced locations along said arm; and (c) a support bracket supporting said arm and pins, said bracket having means defining at least one pair of first and second pivot pin receptacles, each receptacle being respectively associated with one of said pins and effective to allow limited movement of its associated pin therein, each of said receptacles having a fulcrum segment which is effective to form a fulcrum for said arm when its associated pin is engaged therewith, said first receptacle having its segment when disposed against its associated pin to define a first force applying lever arm and said second receptacle having its segment when disposed against its associated pin to define a second force applying lever arm longer than said first force applying lever arm, said receptacles being arranged and spaced apart, whereby upon application of a force to said arm at said force applying portion the arm will be moved through a first arcuate distance with the segment of said first receptacle engaged with its associated pin while the pin associated with said second receptacle undergoes lost motion, and with continued application of force to move said arm, the arm will be moved through a second arcuate distance with the segment of said second receptacle engaged with its associated pin while the pin associated with the first receptacle undergoes lost motion.

8. The assembly as in claim 7, in which force transmitting means are connected to the load receiving portion of said arm, said force transmitting means having resilient means cooperating with the weight of said arms and with the fulcrum segment of said first receptacle to return said arm to its starting position, having the first fulcrum segment engaged with its associated pin, after transversal of said first and second arcuate distances.

9. A dual ratio accelerator arm assembly, comprising:

(a) an accelerator arm having a force applying portion at one extremity and a load receiving portion operatively engaging the engine's throttle at the other extremity;

(b) first and second pivot pins carried by said arm at longitudinally spaced locations along said arm; and (c) bracket for operably supporting said arm, said bracket having means defining a pair of pivot pin receptacles, each receptacle being respectively associated with one of said pins, said receptacles being arranged so that upon application of a force to said arm at said force applying portion, the arm will be moved through a first arc with said first pivot pin engaging a side of a first receptacle associated therewith to constitute a first fulcrum for said arm, and further movement of said arm through a second arc causing said second pivot pin to engage a side of the other receptacle to constitute a second fulcrum for said arm while said first pin undergoes lost motion within said first receptacle.

10. The assembly as in claim 9, in which said arm undergoes an arcuate movement of about 10° during said first arc.

11. The assembly as in claim 9, in which a first ratio of a first lever arm from the load receiving portion to said first pivot pin, to a second lever arm from said first pivot pin to the force applying portion, is greater than a third ratio of the lever arm from the load receiving portion to said second pivot pin, to a fourth lever arm from said second pivot pin to the force applying portion.

12. The assembly as in claim 11, in which the difference between said first and second ratios signals that considerable throttle opening has taken place and that additional throttle opening will be significantly affecting fuel consumption.

13. The assembly as in claim 9, in which lost motion distance traveled by said second pin in said second receptacle is about 0.4".

* * * * *